United States Patent [19]

Toyama et al.

[11] 4,395,243

[45] Jul. 26, 1983

[54] METHOD OF FABRICATING CATHODE-RAY TUBE

[75] Inventors: Noboru Toyama; Yoshinori Oyamada, both of Mobara, Japan

[73] Assignee: Hitachi, Ltd., Tokyo, Japan

[21] Appl. No.: 261,757

[22] Filed: May 8, 1981

[30] Foreign Application Priority Data

May 16, 1980 [JP] Japan ..... 55-64127

[51] Int. Cl.[3] ..... H01J 9/44

[52] U.S. Cl. ..... 445/6; 445/17

[58] Field of Search ..... 316/1, 12, 13, 22, 25, 316/26, 27

[56] References Cited

U.S. PATENT DOCUMENTS

| | | | |
|---|---|---|---|
| 3,121,182 | 2/1964 | Hui et al. | 316/13 X |
| 3,434,770 | 3/1969 | Angelucci et al. | 316/27 X |
| 3,698,786 | 10/1972 | Gronka | 316/1 |

*Primary Examiner*—Kenneth J. Ramsey

*Attorney, Agent, or Firm*—Antonelli, Terry & Wands

[57] ABSTRACT

In a method of fabricating a cathode-ray tube, an evacuated and sealed bulb provided with a phosphor screen and an electron gun including a cathode is subjected to a process of flashing a getter attached to the inner wall of the bulb. Thereafter, the bulb is subjected to a scanning process of causing the electron gun to emit an electron beam therefrom while deflecting the electron beam. The scanning process is followed by an aging process for the cathode of the electron gun.

6 Claims, 2 Drawing Figures

METHOD OF FABRICATING CATHODE-RAY TUBE

The present invention relates to a method of fabricating a cathode-ray tube, and more particularly to processes after a getter flashing process.

Figure 1:
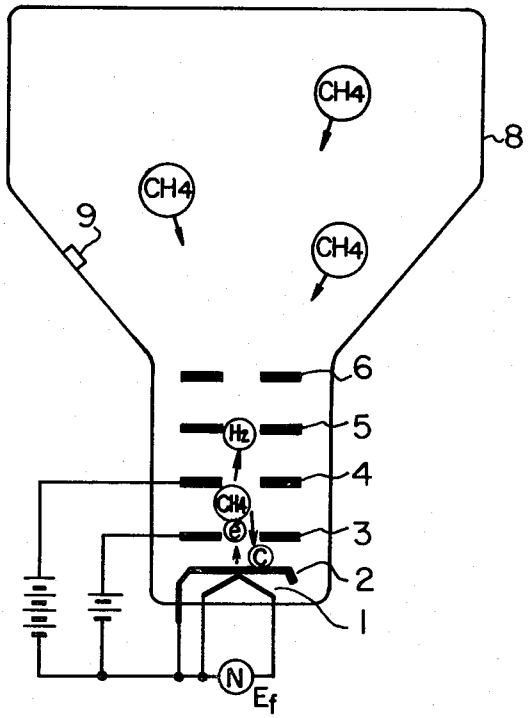
FIG. 1 PRIOR ART

In usual, a cathode-ray tube is fabricated in the following manner. A phosphor screen is formed in the funnel portion of a bulb, and an electron gun is then enclosed in the neck portion of the bulb. The bulb thus constructed is heated in an evacuating furnace and an inner gas including gas molecules absorbed to various parts of the tube but released at the elevated temperature is evacuated by a vacuum pump. During this evacuating process, an oxide coated on a cathode included in the electron gun is discomposed and activated. An exhaust tubulation of the bulb is fused and tipped off or the bulb is sealed after a predetermined vacuum has been attained in the bulb. In this stage, the available vacuum is usually on the order of $10^{-6}$ Torr and gas molecules such as $CH_4$, $H_2O$, $N_2$ and $H_2$ remain in the bulb. A usual approach for further improving the degree of vacuum includes flashing a barium getter prearranged within the bulb (usually, attached to the electron gun) to deposit and form on the inner surface of the bulb a barium film which can absorb some of the remaining gas molecules. However, the partial pressure of the remaining $CH_4$ molecules may be $10^{-6}$ to $10^{-3}$ Torr in some cases, and moreover the barium film has no ability of absorbing $CH_4$ molecules. Accordingly, even after the barium getter has been flashed, $CH_4$ molecules are left as the residual gas in the sealed bulb. In the conventional method, a cathode aging process is performed in this state. That is, using such electrical connections as shown in FIG. 1 of the accompanying drawing, a heater 1 is supplied with a current so as to heat a cathode 2 to 800° to 950° C. to permit the thermionic emission therefrom while electric potentials which are positive with respect to the cathode are applied to first and second grids 3 and 4 to cause an electron current from the cathode 2 to flow into the first and second grids 3 and 4, respectively. Typically, the voltages applied to the heater 1, the first grid 3 and the second grid 4 are 8.2–10.5 V, 5–10 V and 150–300 V respectively. During this againg process, each of the residual $Ch_4$ molecules colliding with electrons flowing into the grid 3 or 4 are decomposed to C and $H_2$. The $H_2$ molecules thus produced are readily absorbed by the barium film, but the carbon atoms adhere to the surface of the cathode to form a carbon layer thereon. The decomposition of $CH_4$ molecules would take place mainly in the neighborhood of the second grid 4 where the electric potential is high and each electron has a large kinetic energy. However, since the cathode 2 is usually spaced apart from the second grid 4 only by a length less than 1 mm, a substantial part of the carbon atoms produced by the decomposition of $CH_4$ may reach a central portion of the cathode 2 through the aperture of the first grid 3 and adhere thereto. As the $H_2$ molecules (or carbon atoms) produced by the decomposition of $CH_4$ molecules existing in the vicinity of the second grid 4 are absorbed by the barium film (or adhere to the cathode surface), another $DH_4$ molecules remaining in the bulb 8 move near the second grid 4 so that they are decomposed thereat. The repetition of such decomposition and displacement of the residual $CH_4$ molecules would result in a substantial amount of carbon atoms deposited on the central portion of the cathode surface. The formation of the carbon layer on the central portion of the cathode 2 which is very important since the thermionic emission is highest at this portion at the ordinary operation of the cathode-ray rube, results in the deterioration of the thermionic emission from the cathode, which will cause various failures in the cathode-ray tube. In FIG. 1, reference numeral 5 designates a third grid, 6 a fourth grid, 8 a bulb, and 9 a barium getter.

It is an object of the present invention to provide a cathode-ray tube fabricating method which can prevent a carbon layer from being formed on the surface of a cathode.

According to the present invention, there is provided a method of fabricating a cathode-ray tube, comprising the sequential steps of: (a) preparing an evacuated and sealed bulb with a funnel portion thereof having a phosphor screen formed thereon and a neck portion thereof having an electron gun mounted therein including a decomposed and activated oxide cathode and an assembly of grids, a getter being attached to a predetermined portion of the interior of said bulb; (b) flashing said getter to deposit a film of getter material on the inner surface of said bulb, so that a large part of gas molecules remaining in said bulb are absorbed by said getter material film; (c) causing said cathode to emit an electron beam while deflecting said electron beam by means of deflecting means arranged around said bulb to scan a region between said cathode and said phosphor screen with said electron beam, so that gas molecules still remaining in said bulb are decomposed by said electron beam; and (d) heating said cathode to emit a predetermined electron current therefrom for aging thereof.

Figure 2:
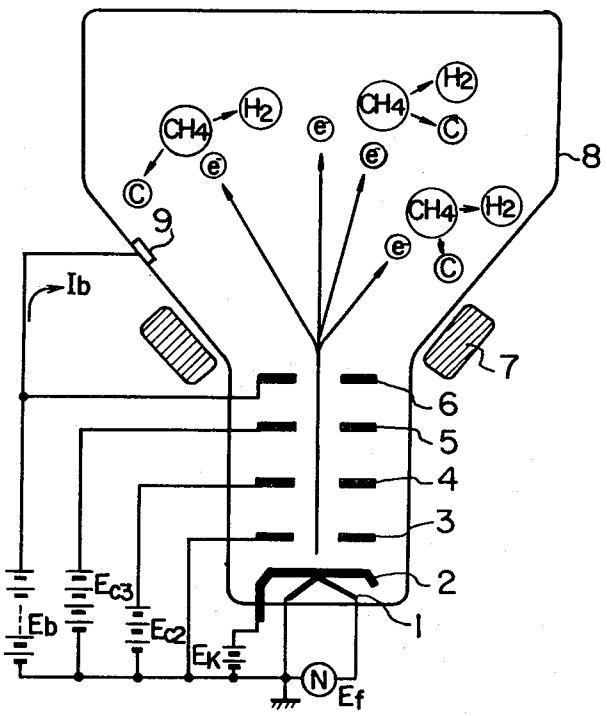

Now, the present invention will be described with reference to the accompanying drawing, in which:

FIG. 1 is a sectional view of a cathode-ray tube for explaining a conventional method of fabricating the cathode-ray tube, in which electrical connections employed in a cathode aging process are illustrated; and FIG. 2 is a sectional view of a cathode-ray tube for explaining a method of fabricating the cathode-ray tube according to an embodiment of the present invention, in which electrical connections employed in a scanning process according to the present invention are illustrated.

Referring to FIG. 2 useful in explaining an embodiment of the present invention, the same elements as in FIG. 1 are provided with the same reference numerals. Reference numeral 7 designates a deflection yoke as deflecting means arranged around the bulb 8. The actual connection of a power source $E_b$ to the bulb 8 and the grid 6 as shown in FIG. 2 is made in such a manner that a conductive coating (not shown) is provided on the inner wall of the bulb 8 and the grid 6 having its lead pin (not shown) connected to the power source $E_b$ is electrically connected to the conductive coating.

There is first prepared an evacuated and sealed bulb 8 with a funnel portion thereof having a phosphor screen formed thereon and a neck portion thereof having an electron gun mounted therein including a decomposed and activated oxide cathode 2 and an assembly of grids 3 to 6, a barium getter 9 being arranged within the bulb 8. Since such a bulb can be prepared by the well known process steps, further explanation will be omitted.

According to the present invention, after the same getter flashing process as in the conventional method has been performed, a scanning process is carried out in such a manner that a high-speed electron beam is emitted from the cathode 2 of an electron gun to a phosphor screen while it is deflected both in the horizontal direction and in the vertical direction by means of the yoke 7 to scan a space in the bulb 8 successively and repeatedly with the electron beam. It is preferable that the scanning with the electron beam is made at a condition similar to the ordinary operation of the cathode-ray tube in the practical use thereof. As a result, residual $CH_4$ molecules distributed in a wide region between the electron gun and the phosphor screen in the cathode-ray tube, collide with electrons in the electron beam and are decomposed to C and $H_2$. In the aging process shown in FIG. 1, the electron current flows only in a narrow region between the cathode 2 and the second grid 4. On the other hand, in the scanning process according to the present invention as shown in FIG. 2, a wide region between the cathode 2 and the phosphor screen in the cathode-ray tube is subjected to the scanning with the electron beam. Accordingly, the decomposition of $CH_4$ molecules by the electron beam mainly takes place in a region between the electron gun and the phosphor screen, that is, at locations which are far apart from the cathode 2. Therefore, a probability that carbon atoms produced by the decomposition reach the cathode 2 is extremely low. In other words, though most of residual $CH_4$ molecules decompose in the scanning process, only a very thin carbon layer is formed on the cathode surface during a scanning time (generally 3 to 5 minutes). After the scanning process, the cathode 2 is subjected to the aging process using the electrical connections as shown in FIG. 1. Since any $CH_4$ molecule can scarcely remain after the scanning process, the phenomenon that carbon atoms adhere to the cathode surface to form a carbon layer thereon does not take place any more during the aging process. Inversely, the very thin carbon layer which has been formed in the scanning process, can be evaporated and removed through its heating by the current flowing through the heater 1 in the aging process. As a result, the cathode surface can enjoy a normal and excellent thermonic emission ability.

The scanning process for 14 to 20 inch tubes is carried out, for example, under the following conditions.

$E_f$: 6.3–7.0 V
$E_k$: about 100 V
$E_{c2}$: about 500 V
$E_{c3}$: about 6 kV
$E_b$: about 22 kV
$I_b$: about 800 $\mu$A
scanning time: 3–5 minutes In order to study the effects of the present invention, the inventors prepared cathode-ray tubes the degree of vacuum of each of which was on the order of $10^{-3}$ Torr after the getter flashing, that is, in which $CH_4$ molecules substantially remained. Some of the cathode-ray tubes were subjected to the aging process immediately after the getter flashing process in accordance with the conventional method, and the remaining cathode-ray tubes were subjected to the scanning process and then the aging process in accordance with the present invention. The results of the measured degree of vacuum and the observation of the cathode surface state (the formation of carbon layer on the cathode surface) are compared in Table I. The cathode surface state was observed by a ×40 microscope.

TABLE I

| | | conventional method | inventive method |
|---|---|---|---|
| after scanning | degree of vacuum | | $10^{-7}$ Torr |
| | formation of carbon layer | | slight |
| after aging | degree of vacuum | $10^{-7}$ Torr | $10^{-7}$ Torr |
| | formation of carbon layer | remarkable | none |

As has been explained in the foregoing, according to the present invention, the formation of the carbon layer on the cathode surface is prevented so that an excellent thermionic emission ability can be attained.

What is claimed is:

1. A method of fabricating a cathode-ray tube, comprising the sequential steps of:

(a) preparing an evacuated and sealed bulb with a funnel portion thereof having a phosphor screen formed thereon and a neck portion thereof having an electron gun mounted therein including a decomposed and activated oxide cathode and an assembly of grids, a getter being attached to a predetermined portion of the interior of said bulb;

(b) flashing said getter to deposit a film of getter material on the inner surface of said bulb, so that a large part of gas molecules remaining in said bulb are absorbed by said getter material film;

(c) causing said cathode to emit an electron beam while deflecting said electron beam by means of deflecting means arranged around said bulb to scan a region between said cathode and said phosphor screen with said electron beam, so that gas molecules still remaining in said bulb are decomposed by said electron beam; and (d) heating said cathode to emit a predetermined electron current therefrom for aging thereof.

2. A method according to claim 1, wherein the deflection of said electron beam in said step (c) is made in both horizontal and vertical directions so that a space in said bulb is wholly scanned with said electron beam.

3. A method according to claim 1, wherein the scanning with said electron beam in said step (c) is made for 3 to 5 minutes.

4. A method according to claim 1 or 2, wherein the scanning with said electron beam in said step (c) is made with the grids of the grid assembly of said electron gun applied with substantially the same voltages as in an ordinary operation of said cathode-ray tube.

5. A method according to claim 4, wherein the grid assembly of said electron gun includes first, second, third and fourth grids in the order of the proximity to said oxide cathode, and wherein in said step (c), said cathode, said first grid, said second grid, said third grid and said fourth grid are applied with about 100 V, 0 V, about 500 V, about 6 kV and about 22 kV, respectively.

6. A method according to claim 1, wherein said getter is made of barium and the gas molecules decomposed by said electron beam in said step (c) are $CH_4$.

* * * * *